US009938983B2

(12) United States Patent
Stalder et al.

(10) Patent No.: US 9,938,983 B2
(45) Date of Patent: Apr. 10, 2018

(54) COMPRESSOR WITH THRUST BALANCING AND METHOD THEREOF

(71) Applicant: Thermodyn Sas, Le Creusot (FR)

(72) Inventors: Benjamin Stalder, Lyons (FR); Thomas Alban, Chatenoy le Royal (FR)

(73) Assignee: Thermodyn SAS, Le Creusot (FR)

( * ) Notice: Subject to any disclaimer, the term of this patent is extended or adjusted under 35 U.S.C. 154(b) by 288 days.

(21) Appl. No.: 14/441,326

(22) PCT Filed: Nov. 5, 2013

(86) PCT No.: PCT/EP2013/073068

§ 371 (c)(1),
(2) Date: May 7, 2015

(87) PCT Pub. No.: WO2014/072295

PCT Pub. Date: May 15, 2014

(65) Prior Publication Data

US 2015/0308443 A1 Oct. 29, 2015

(30) Foreign Application Priority Data

Nov. 7, 2012 (FR) ..... 12 02982

(51) Int. Cl.
*F04D 29/051* (2006.01)
*F04D 29/12* (2006.01)
*F04D 27/02* (2006.01)

(52) U.S. Cl.
CPC ..... *F04D 29/0513* (2013.01); *F04D 27/02* (2013.01); *F04D 29/0516* (2013.01); *F04D 29/124* (2013.01)

(58) Field of Classification Search
CPC ..... F04D 29/0516; F04D 29/0416; F04D 29/2266; F04D 27/02; F04D 27/0215
See application file for complete search history.

(56) References Cited

U.S. PATENT DOCUMENTS 3,678,234 A 7/1972 Floessel
3,811,805 A 5/1974 Moody, Jr. et al.
(Continued)

FOREIGN PATENT DOCUMENTS

EP 0107894 B1 1/1990
EP 0361844 A3 7/1990
(Continued)

OTHER PUBLICATIONS

Tchigique B: "Gas Seals Philosophy of Instrumentation", Petrole Et Techniques, Issue No. 370, pp. 42-47, Feb. 1, 1992.
(Continued)

*Primary Examiner* — Logan Kraft
*Assistant Examiner* — Sabbir Hasan
(74) *Attorney, Agent, or Firm* — GE Global Patent Operation

(57) ABSTRACT

A compressor for a motor-compressor set, comprising, on a rotating shaft, a balancing piston, a set of bladed wheels, a rear cavity of the piston adjacent to the balancing piston on a side opposite to the set of bladed wheels, a regulation valve suitable for coupling the rear cavity to the input of the set of bladed wheels, a suction pressure chamber coupled to the input of the set of bladed wheels, the rear cavity being arranged between the balancing piston and the suction pressure chamber. The compressor comprises a discharge pressure chamber arranged between the rear cavity of the piston and the suction pressure chamber, the discharge pressure chamber being coupled via a discharge line to a discharge area between the set of bladed wheels and the balancing piston.

15 Claims, 1 Drawing Sheet

(56) References Cited

U.S. PATENT DOCUMENTS

| | | | | |
|---|---|---|---|---|
| 3,865,127 | A | 2/1975 | Lewis | |
| 3,922,114 | A | 11/1975 | Hamilton et al. | |
| 3,982,504 | A | 9/1976 | Noguchi et al. | |
| 4,047,728 | A | 9/1977 | Takahashi et al. | |
| 4,135,864 | A | 1/1979 | Lassota | |
| 4,137,021 | A | 1/1979 | Lassota | |
| 4,181,474 | A | 1/1980 | Shaw | |
| 4,382,370 | A | 5/1983 | Suefuji et al. | |
| 4,431,356 | A | 2/1984 | Lassota | |
| 4,431,387 | A | 2/1984 | Lassota | |
| 4,708,599 | A | 11/1987 | Suzuki | |
| 4,725,196 | A * | 2/1988 | Kaneki | F04D 29/104 415/100 |
| 4,930,464 | A | 6/1990 | Letsche | |
| 5,979,790 | A | 11/1999 | Guerich et al. | |
| 6,293,348 | B1 | 9/2001 | Reilly | |
| 6,464,469 | B1 | 10/2002 | Grob et al. | |
| 7,144,226 | B2 * | 12/2006 | Pugnet | F04D 17/125 417/244 |
| 2013/0115042 | A1 * | 5/2013 | Mariotti | F04D 29/0516 415/1 |

FOREIGN PATENT DOCUMENTS

| | | | |
|---|---|---|---|
| EP | 0276845 | B1 | 7/1992 |
| FR | 2418880 | A1 | 9/1979 |
| FR | 2638484 | A1 | 5/1990 |
| GB | 782653 | A | 9/1957 |
| JP | 55101795 | A | 8/1980 |
| JP | 01187395 | A | 7/1989 |
| JP | H01-237394 | A | 9/1989 |
| JP | 05263789 | A | 10/1993 |
| JP | 08232885 | A | 9/1996 |
| JP | 2002-257080 | A | 9/2002 |
| JP | 2006183465 | A | 7/2006 |
| RU | 2 133 880 | C1 | 7/1999 |
| RU | 2 448 277 | C1 | 4/2012 |
| SU | 437848 | A1 | 7/1974 |
| WO | 9104416 | A1 | 4/1991 |
| WO | 9105167 | A1 | 4/1991 |
| WO | 02084122 | A3 | 12/2002 |
| WO | 2011078680 | A | 6/2011 |

OTHER PUBLICATIONS

PCT Search Report and Written Opinion issued in connection with corresponding PCT Application No. PCT/EP2013/073068 dated Feb. 6, 2014.

Unofficial English Translation of Chinese Office Action issued in connection with corresponding CN Application No. 01380058431.7 dated Nov. 16, 2016.

Decision to Grant and Search issued in connection with corresponding RU Application No. 2015117250 dated Sep. 21, 2017.

Machine Translation and Notification of Reason for Refusal issued in connection with corresponding JP Application No. 2015-541103 dated Sep. 26, 2017.

* cited by examiner

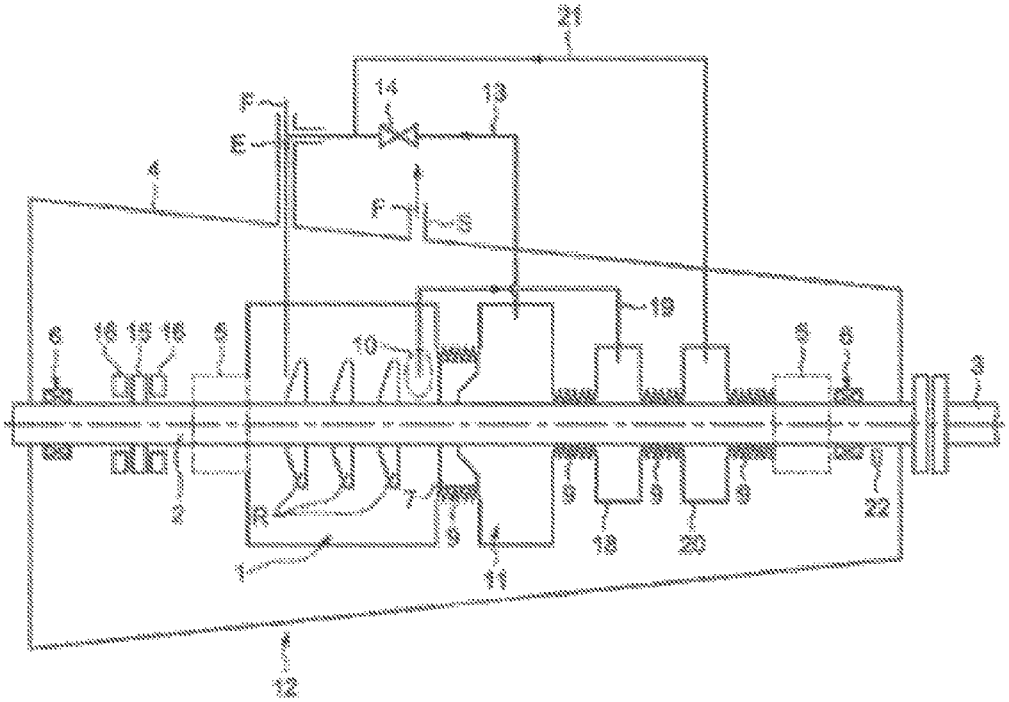
21
14
13
F
E
4
F
5
19
6
16
15
16
6
10
9
6
3
2
R
7
9
9
9
22
1
5
11
19
20
12

COMPRESSOR WITH THRUST BALANCING AND METHOD THEREOF

BACKGROUND

Embodiments of the present invention relate generally to the balancing of the thrust exerted in a centrifugal compressor, and more particularly to improving the maximum thrust that the architecture of a centrifugal compressor can withstand.

In operation, the rotor of a centrifugal compressor is generally subjected to significant thrusts. These thrusts are due to the pressure difference prevailing between the stages and to the quantity of movement created by the change of direction of the gas, from an axial direction to a radial direction. The flow rate tends to generate a thrust directed from the suction to the discharge of the compressor. The pressure difference at the limits of each wheel thrusts in the opposite direction.

The compensation of such a phenomenon is generally carried out by using a balancing piston which acts in the same direction as the thrust due to the flow rate. Bearing in mind that the compressor is likely to operate in various conditions, the piston is designed to reduce the thrust field across the entire operating range. A thrust bearing is installed to counter the residual thrust which remains despite the balancing implemented by the piston.

In certain specific cases of compressors, such as, for example, compressors with a wide flow rate range, that is to say with a high flow rate coefficient, the thrust bearing is not sufficient. To overcome this failing, it is known practice to place a control valve on the balancing line, that is to say between the rear cavity of the piston and the suction of the compressor. The valve is controlled by a thrust measurement probe, and regulates the pressure in the rear cavity of the piston. The thrust is therefore cancelled or at least reduced to keep it within the capability of the thrust bearing.

To avoid gas leaks that can damage the bearings or the dynamic seals when the control valve is closed and the rear cavity is pressurized, a suction chamber is arranged after the rear cavity of the piston via a labyrinth seal, and coupled via a suction pipe to the suction line at the output of the control valve.

However, this solution does not make it possible to compensate the thrust in the case of high gas flow rate. In practice, even with the control valve closed on the balancing line, it is not possible to reach the discharge pressure in the rear cavity of the piston, which results in a limiting of the thrust compensation.

SUMMARY

One object of embodiments of the invention is therefore to increase the thrust range that can be used and therefore increase the flow rate range covered by the compressor.

To this end, an embodiment proposes a compressor for a motor-compressor set, comprising, on a rotating shaft, a balancing piston, a set of bladed wheels, a rear cavity of the piston adjacent to the balancing piston on a side opposite to the set of bladed wheels, a regulation valve suitable for coupling the rear cavity to the input of the set of bladed wheels, a suction pressure chamber coupled to the input of the set of bladed wheels, the rear cavity being arranged between the balancing piston and the suction pressure chamber.

According to a general feature, the compressor comprises a discharge pressure chamber arranged between the rear cavity of the piston and the suction pressure chamber, the discharge pressure chamber being coupled via a discharge line to a discharge area situated between the set of bladed wheels and the balancing piston.

The discharge pressure chamber arranged between the rear cavity of the piston and the suction pressure chamber thus makes it possible to balance the pressures on either side of the balancing piston when the compressor is operating at high flow rate, that is to say for pressure ratios per bladed wheel of between 1.05 and 1.2, and thus avoid leaks to the sealing means or the bearings. In practice, by closing the regulation valve, the gases contained in the discharge area, and those contained in the discharge pressure chamber coupled to the discharge area, will migrate towards the piston rear cavity where the pressure is less great until a pressure close to the discharge pressure is obtained in the piston rear cavity. The pressure difference on either side of the balancing piston is cancelled, thus reducing the thrust force exerted on the rotating shaft.

In an embodiment, the compressor comprises an input flange emerging on a gas input line coupled to the input of the set of bladed wheels.

The gas input line and the suction line are thus both coupled to the input of the set of bladed wheels, the set of bladed wheels then receiving gas injected from the input flange as well as gas from the suction chamber. The gases from the suction chamber emanate from the gas leaks from the discharge pressure chamber. The suction pressure chamber makes it possible on the one hand to avoid having gas leaks from the discharge pressure chamber reach and damage the sealing means or the bearings, and makes it possible on the other hand to recycle the gas lost in the leaks between chambers.

The compressor can comprise labyrinth seals arranged between the suction pressure chamber and the discharge pressure chamber on the one hand, and between the discharge pressure chamber and the rear cavity of the piston on the other hand.

The compressor can, in an embodiment, comprise a compressor jacket suitable for comprising the set of bladed wheels, the balancing piston, the rear cavity of the piston, the discharge pressure chamber, and the suction pressure chamber, the jacket being closed in a seal-tight manner by sealing means mounted on the rotating shaft or on the stator on either side of the compression chamber.

The compressor can, in an embodiment, comprise magnetic bearings or oil bearings suitable for supporting the rotating shaft.

The compressor can also comprise an abutment mounted on the rotating shaft and suitable for abutting on support means arranged on either side of the abutment and independent of the rotating shaft.

The compressor can comprise a sensor suitable for measuring the level of thrust on the rotating shaft, and control means suitable for controlling the control valve on the basis of the measured thrust level.

According to another aspect, a motor-compressor set is proposed comprising a motor, and a compressor as defined above.

Other advantages and features of the invention will become apparent on studying the following description of a nonlimiting embodiment of the invention, given with reference to the appended drawing which schematically shows an example of a compressor according to an embodiment of the invention.

BRIEF DESCRIPTION

The accompanying drawing, which are incorporated in and constitute a part of the specification, illustrate one or more embodiments and, together with the description, explain these embodiments. In the drawing:

FIG. 1 is a depiction of a compressor according to an embodiment of the present invention.

DETAILED DESCRIPTION

In the exemplary embodiment illustrated, the compressor is a compressor in which the compression section 1 comprises a set of compression bladed wheels R ensuring the compression of a gas delivered at the input E of the compressor to deliver at the output S the gas manipulated by the compressor (arrows F).

The bladed wheels R are mounted on a driven shaft 2 driven in rotation by a motor shaft 3.

The compression section 1 of the compressor is placed, in the embodiment illustrated, in a compressor jacket 4 kept seal-tight by virtue of sealing means 5 arranged on either side of the compressor jacket along the driven shaft 2. The sealing means 5 can be dry packings comprising, among other things, a system of cavities separated by seals, for example labyrinth seals.

The compressor also comprises bearings 6, here two of them, making it possible to support the driven shaft 2. The bearings 6 can be magnetic bearings. The bearings 6 can also be oil bearings, in which case dry packings are used as sealing means 5.

Downstream of the last bladed wheel R, considering the circulation of the gas manipulated in the compression section 1, the compressor comprises a balancing piston 7 mounted on the driven shaft 2, intended to compensate the axial thrust exerted by the bladed wheels on the driven shaft 2. The leaks of compressed gas in the discharge area 10 of the last bladed wheel R, that is to say the one closest to the output S and to the balancing piston 7, are reduced using a labyrinth seal system 9 arranged at the level of the piston. The axial thrust to which the driven shaft 2 is subjected is mainly due to the pressure difference at the limits of each bladed wheel in one direction, and to the gas flow rate in the compressor in an opposite direction, the amplitude of the forces exerted varying according to the operating mode.

The compression section 1 comprises a piston rear cavity 11 on the side of the balancing piston 7 opposite to the bladed wheels R. The rear cavity 11 is coupled to the input of the bladed wheels R via a balancing line 13 comprising a controlled regulation valve 14.

The pressure difference at the limits of the piston, that is to say between the discharge area on one side of the balancing piston 7 and the piston rear cavity 11 on the other side of the balancing piston 7, makes it possible to recentre the residual thrust and minimize its variation.

The residual axial thrust is countered by a system comprising an abutment 15 securely attached to the driven shaft 2 and two stator parts 16 situated on either side of the abutment 15 and independent of the driven shaft 2 so as to restrict the axial movement of the driven shaft 2.

When the machine is equipped with a balancing piston 7, the leaks at the labyrinth 9 are returned to the suction of the compressor via the balancing line 13. The regulation valve 14 regulates the pressure in the rear cavity 11 of the piston so as to obtain the requisite thrust on the balancing piston 7.

When the compressor is used for high flow rates, the piston emphasizes the thrust until the capability of the abutment is exceeded.

To cancel the thrust exerted on the balancing piston 7, the pressures on either side of the balancing piston 7, that is to say between the discharge area 10 and the piston rear cavity 11, are balanced.

For this, the regulation valve 14 is closed so as to fill the rear cavity 11 with the gases leaking from the discharge area 10 to the rear cavity. In order to be able to reach the discharge pressure in the rear cavity, the compressor comprises a discharge pressure chamber 18 arranged after the piston rear cavity 11 and coupled to the discharge area 10 via a discharge line 19.

The discharge pressure chamber 18, being coupled directly to the discharge area 10, has a pressure corresponding to the discharge pressure. The pressure in the piston rear cavity 11 being less than the discharge pressure, the discharge chamber 18 leaks into the rear cavity 11 of the piston via the labyrinth seal 9 separating the discharge chamber 18 from the piston rear cavity 11.

It is thus possible to have a compressor in which the thrust range which can be used has been increased.

To avoid the gas leaks between the discharge pressure chamber 18 and the shaft-end seals, the compression section 1 comprises a suction pressure chamber 20 coupled via a suction line 21 to the suction, that is to say to the input E downstream of the valve 14.

In practice, without this suction pressure chamber 20, leak problems could damage the sealing means 5 or, directly, the bearings 6 in the case of magnetic bearings. The discharge pressure in the discharge chamber could result in a penetration of gas at discharge pressure into the sealing means 5 and damage thereto. On the magnetic bearings, the gases at discharge pressure are at high temperature and can in fact leak to the magnetic bearings and heat them until they are damaged.

The suction pressure chamber 20 is situated just to the side of the discharge pressure chamber 18 protecting the sealing means 5 or, directly, the bearings 6, with the interposition of a labyrinth seal 9. With this configuration, the discharge pressure is present in areas on both sides of the rear cavity 11 of the piston 7 and, when the valve is closed, the gases can leak into the piston rear cavity 11 until virtually the discharge pressure is obtained in the piston rear cavity.

To control the control valve 14, the compressor comprises measurement means 22 periodically measuring the level of thrust exerted on the driven shaft 2. The measurement means 22 can, for example, comprise a temperature sensor measuring the heating of the thrust bearing, or a flow rate sensor measuring the gas flow rate in the compressor. The information obtained is sent to a control unit which converts this data into an opening/closure signal for the control valve 14. When the control valve 14 is closed, the gas circulates from the discharge area to the rear cavity 11 of the piston 7. Then, the only remaining way out is to go into the suction pressure chamber.

An embodiment of the invention makes it possible to obtain a compressor with a wide flow rate range.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A compressor for a motor-compressor set, the compressor comprising:

a rotating shaft;

a balancing piston;

a set of bladed wheels;

a rear cavity of the balancing piston adjacent to the balancing piston on a side opposite to the set of bladed wheels;

a regulation valve configured to couple the rear cavity to the input of the set of bladed wheels;

a suction pressure chamber coupled to the input of the set of bladed wheels, wherein the rear cavity is between the balancing piston and the suction pressure chamber; and a discharge pressure chamber between the rear cavity of the balancing piston and the suction pressure chamber, the discharge pressure chamber being coupled via a discharge line to a discharge area between a last bladed wheel of the set of bladed wheels and the balancing piston.

2. The compressor according to claim 1, further comprising an input flange emerging on a gas input line coupled to the input of the set of bladed wheels.

3. The compressor according to claim 1, further comprising labyrinth seals between the suction pressure chamber and the discharge pressure chamber on the one hand, and between the discharge pressure chamber and the rear cavity of the balancing piston on the other hand.

4. The compressor according to claim 1, further comprising a compressor jacket comprising the set of bladed wheels, the balancing piston, the rear cavity of the balancing piston, the discharge pressure chamber, and the suction pressure chamber, the compressor jacket being closed in a seal-tight manner by a seal mounted on the rotating shaft on either side of the compression chamber.

5. The compressor according to claim 1, further comprising bearings configured to support the rotating shaft.

6. The compressor according to claim 1, further comprising an abutment mounted on the rotating shaft configured to abut on a support on either side of the abutment and independent of the rotating shaft.

7. The compressor according to claim 1, further comprising a sensor configured to measure the level of thrust on the rotating shaft, and the regulation valve further configured to open and close on the basis of the measured thrust level.

8. A motor-compressor set comprising:

a motor; and a compressor, comprising:

a rotating shaft;

a balancing piston;

a set of bladed wheels;

a rear cavity of the balancing piston adjacent to the balancing piston on a side opposite to the set of bladed wheels;

a regulation valve configured to couple the rear cavity to the input of the set of bladed wheels;

a suction pressure chamber coupled to the input of the set of bladed wheels, wherein the rear cavity is between the balancing piston and the suction pressure chamber; and a discharge pressure chamber between the rear cavity of the balancing piston and the suction pressure chamber, the discharge pressure chamber being coupled via a discharge line to a discharge area between a last bladed wheel of the set of bladed wheels and the balancing piston.

9. The compressor according to claim 8, further comprising an input flange emerging on a gas input line coupled to the input of the set of bladed wheels.

10. The compressor according to claim 8, further comprising labyrinth seals between the suction pressure chamber and the discharge pressure chamber on the one hand, and between the discharge pressure chamber and the rear cavity of the balancing piston on the other hand.

11. The compressor according to claim 8, further comprising a compressor jacket comprising the set of bladed wheels, the balancing piston, the rear cavity of the balancing piston, the discharge pressure chamber, and the suction pressure chamber, the compressor jacket being closed in a seal-tight manner by a seal mounted on the rotating shaft on either side of the compression chamber.

12. The compressor according to claim 8, further comprising bearings configured to support the rotating shaft.

13. The compressor according to claim 8, further comprising an abutment mounted on the rotating shaft configured to abut on a support on either side of the abutment and independent of the rotating shaft.

14. The compressor according to claim 8, further comprising a sensor configured to measure the level of thrust on the rotating shaft, and the regulation valve further configured to open and close on the basis of the measured thrust level.

15. A method for balancing the thrust exerted on a balancing piston coupled to a rotating shaft of a compressor, wherein the compressor comprises a set of bladed wheels, a rear cavity of the balancing piston adjacent to the balancing piston on a side opposite to the set of bladed wheels, a regulation valve configured to couple the rear cavity to the input of the set of bladed wheels via a balancing line, a suction pressure chamber coupled to the input of the set of bladed wheels via a suction line, wherein the rear cavity is between the balancing piston and the suction pressure chamber, the method comprising: coupling a discharge pressure chamber between the rear cavity of the balancing piston and the suction pressure chamber to a discharge area between a last bladed wheel of the set of bladed wheels and the balancing piston.

* * * * *